US011136148B2

(12) United States Patent
Rehbein

(10) Patent No.: US 11,136,148 B2
(45) Date of Patent: Oct. 5, 2021

(54) MEDICAMENT CONTAINER AND METHOD FOR PRODUCING SAME

(71) Applicant: Sanofi-Aventis Deutschland GMBH, Frankfurt am Main (DE)

(72) Inventor: Christian Rehbein, Frankfurt am Main (DE)

(73) Assignee: Sanofi-Aventis Deutschland GMBH, Frankfurt am Main (DE)

( * ) Notice: Subject to any disclaimer, the term of this patent is extended or adjusted under 35 U.S.C. 154(b) by 134 days.

(21) Appl. No.: 16/067,760

(22) PCT Filed: Jan. 5, 2017

(86) PCT No.: PCT/EP2017/050176
§ 371 (c)(1),
(2) Date: Jul. 2, 2018

(87) PCT Pub. No.: WO2017/118681
PCT Pub. Date: Jul. 13, 2017

(65) Prior Publication Data

US 2019/0002135 A1 Jan. 3, 2019

(30) Foreign Application Priority Data

Jan. 6, 2016 (EP) ..... 16150289

(51) Int. Cl.
*B65B 3/00* (2006.01)
*A61J 1/05* (2006.01)
(Continued)

(52) U.S. Cl.
CPC ..... *B65B 3/003* (2013.01); *A61J 1/05* (2013.01); *B65B 3/022* (2013.01); *B65D 1/023* (2013.01); *B67C 2003/227* (2013.01)

(58) Field of Classification Search
None
See application file for complete search history.

(56) References Cited

U.S. PATENT DOCUMENTS 3,016,896 A 1/1962 Van Sickle
4,235,235 A 11/1980 Bekkering
(Continued)

FOREIGN PATENT DOCUMENTS

CN 1185024 7/2003
CN 101001784 7/2007
(Continued)

OTHER PUBLICATIONS

International Search Report and Written Opinion in International Application No. PCT/EP2017/050176, dated Mar. 8, 2017, 7 pages.
(Continued)

*Primary Examiner* — Monica A Huson
(74) *Attorney, Agent, or Firm* — Fish & Richardson P.C.

(57) ABSTRACT

The present disclosure relates to a method for producing, filling and sealing a medicament container. The method includes a blow-fill seal process including inflating a parison within a mold to form the medicament container, filling a medicament into the medicament container, and sealing a distal end of a neck of the medicament container, wherein the mold is dimensioned such that the neck is formed with an internal radius small enough to allow for a capillary effect of the medicament so that an air bubble remaining in the neck after filling and sealing the medicament container is fixed within the neck (by capillary forces. The present disclosure also relates to a medicament container produced by said method.

8 Claims, 3 Drawing Sheets

(51) Int. Cl.

| | |
|---|---|
| ***B65D 1/02*** | (2006.01) |
| ***B65B 3/02*** | (2006.01) |
| *B67C 3/22* | (2006.01) |

(56) References Cited

U.S. PATENT DOCUMENTS

| | | | | |
|---|---|---|---|---|
| 4,671,763 | A * | 6/1987 | Weiler | B29C 49/42 264/524 |
| 4,926,613 | A | 5/1990 | Hansen | |
| 9,108,777 | B1 | 8/2015 | Santamarta | |
| 2008/0275404 | A1 | 11/2008 | Hansen | |
| 2010/0163577 | A1 | 7/2010 | Hansen | |
| 2012/0094045 | A1 | 4/2012 | Yamamoto et al. | |
| 2014/0367895 | A1 | 12/2014 | Sato et al. | |
| 2015/0239594 | A1 | 8/2015 | Batema | |

FOREIGN PATENT DOCUMENTS

| | | |
|---|---|---|
| CN | 102470582 | 5/2012 |
| CN | 104136195 | 11/2014 |
| CN | 105188636 | 12/2015 |
| CN | 204846579 | 12/2015 |
| DE | 102007009457 | 8/2008 |
| EP | 0995419 | 4/2000 |
| JP | H02-139303 | 5/1990 |
| JP | 2009-286498 | 12/2009 |
| JP | 2010-510018 | 4/2010 |
| WO | WO 2001/89614 | 11/2001 |
| WO | WO 02/49821 | 6/2002 |
| WO | WO 2006/032320 | 3/2006 |
| WO | WO 2008/062203 | 5/2008 |
| WO | WO 2014/140152 | 9/2014 |

OTHER PUBLICATIONS

International Preliminary Report on Patentability in International Application No. PCT/EP2017/050176, dated Jul. 10, 2018, 5 pages.

Thielen et al., "Blasformen: von Kunststoffhohlkörpern," Carl Hanser Verlag GmbH Co KG, Dec. 9, 2019, 2(6):143-145 (with English Machine Translation).

* cited by examiner

MEDICAMENT CONTAINER AND METHOD FOR PRODUCING SAME

CROSS REFERENCE TO RELATED APPLICATIONS

The present application is the national stage entry of International Patent Application No. PCT/EP2017/050176, filed on Jan. 5, 2017, and claims priority to Application No. EP 16150289.3, filed on Jan. 6, 2016, the disclosures of which are incorporated herein by reference.

TECHNICAL FIELD

The disclosure generally relates to a medicament container and to a method for producing same.

BACKGROUND

U.S. Pat. No. 9,108,777 describes that blow-fill seal technology (BFS) refers to the manufacturing process used to produce various sized liquid filled vials ranging from as small as 0.1 mL to over 500 mL. Originally developed in Europe in the 1930s, it was introduced in the United States in the 1960s. Since the 1990s, BFS has become more prevalent within the pharmaceutical industry, and is now widely considered to be the superior form of aseptic processing by various medicine regulatory agencies including the U.S. Food and Drug Administration (FDA) in the packaging of pharmaceutical and healthcare products.

There remains a need to provide an improved medicament container and an improved method for producing same.

SUMMARY

Some aspects of the present disclosure can be implemented to provide an improved medicament container and an improved method for producing same.

According to the present disclosure, a method for producing, filling and sealing a medicament container comprises a blow-fill seal process comprising:

- a molding step, in which a parison is inflated within a mold to form the medicament container,
- a filling step, in which a medicament is filled into the medicament container, and
- a sealing step, in which a distal end of a neck of the medicament container is sealed, wherein the mold is dimensioned such that the neck is formed with an internal radius small enough to allow for a capillary effect of the medicament so that an air bubble remaining in the neck after the filling step and the sealing step is fixed within the neck by capillary forces.

The capillary forces prevent the air bubble from moving through the medicament when the medicament container is moved, e.g. during shipping. Movement of the air bubble within the medicament can otherwise subject the medicament to shear forces which may cause degeneration of the medicament. If the medicament is filled into the medicament container from bottom to top, the air bubble is located at the top of the medicament container, e.g. within the neck after the filling step.

In an exemplary embodiment the mold is dimensioned such that the neck is formed with an internal radius small enough to allow for a capillary effect of the medicament with a capillary pressure of at least 100 mBar.

In an exemplary embodiment the mold is dimensioned such that the neck is formed with an internal radius of at most 1.4 mm.

In an exemplary embodiment the mold is dimensioned such that the neck is formed with a length of 7 mm to 30 mm.

In an exemplary embodiment, in the sealing step, the neck is cut through a section holding the air bubble.

According to the present disclosure, a medicament container for a liquid medicament is produced by a the above described method and has a neck with an internal radius small enough to allow for a capillary effect of the medicament so that an air bubble remaining in the neck is fixed within the neck by capillary forces.

In an exemplary embodiment the internal radius of the neck is small enough to allow for a capillary effect of the medicament with a capillary pressure of at least 100 mBar.

In an exemplary embodiment the internal radius of the neck is at most 1.4 mm.

In an exemplary embodiment the neck has a length of 7 mm to 30 mm.

Further scope of applicability of the present disclosure will become apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE FIGURES

The present disclosure will become more fully understood from the detailed description given below and the accompanying drawings, which are given by way of illustration only, and do not limit the present disclosure, and wherein.

Corresponding parts are marked with the same reference symbols in all figures.

DETAILED DESCRIPTION

Figure 1:
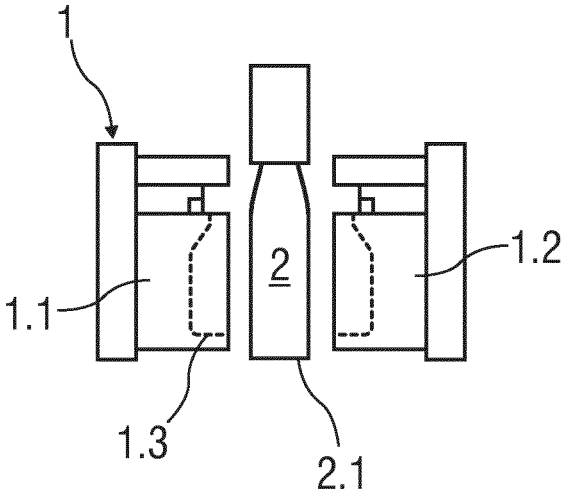
FIG. 1 is a schematic view of a mold and a parison during an extrusion step of a blow-fill-seal process for producing, filling and sealing a medicament container.

FIG. 1 is a schematic view of a mold 1 and a parison 2 during an extrusion step of a blow-fill-seal process for producing, filling and sealing a medicament container. The mold 1 comprises two halves 1.1, 1.2 that can be closed to form a cavity within and that can be opened to allow inserting a parison 2 and removing a medicament container. The parison 2 may be a hollow tube, e.g. produced by extruding a homogenous polymer melt through a circular orifice. The parison 2 is inserted into the open mold 1 and may be cut at a proximal end 2.1, e.g. below the mold 1.

Figure 2:
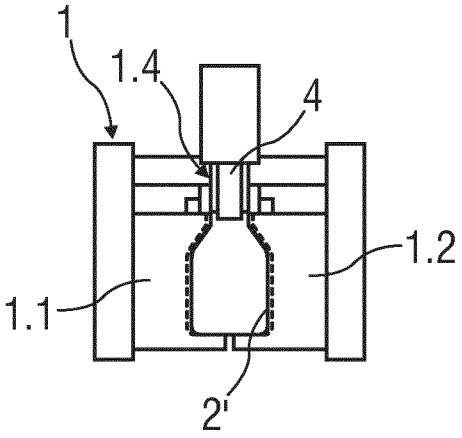
FIG. 2 is a schematic view of the mold and the medicament container during a molding step of the blow-fill-seal process.

Subsequently during a molding step the mold 1 is closed and thus seals a bottom 1.3 of the cavity enclosed by the mold 1. A mandrel unit 4 is inserted into a neck area 1.4 of the mold 1 and inflates the parison 2, e.g. using compressed air such that the parison 2 abuts the walls of the cavity and forms the medicament container 2'. FIG. 2 is a schematic view of the mold 1 and the medicament container 2' at the end of the molding step of the blow-fill-seal process.

Figure 3:
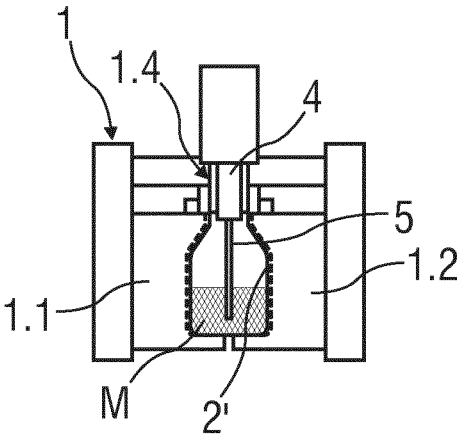
FIG. 3 is a schematic view of the mold and the medicament container during a filling step of the blow-fill-seal process.

FIG. 3 is a schematic view of the mold 1 and the medicament container 2' during a filling step of the blow-fill-seal process. A medicament M is filled into the medicament container 2' by the mandrel unit 4 which may have a thin filling tube 5 extending far into the medicament container 2' to allow filling from bottom to top.

Figure 4:
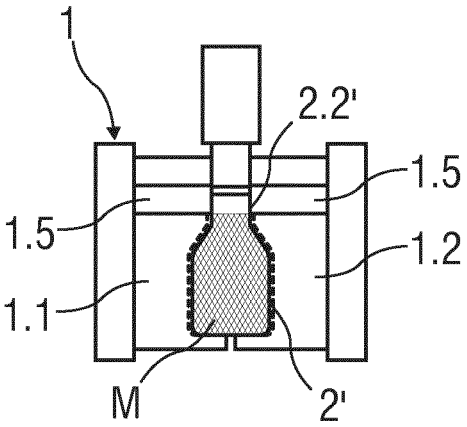
FIG. 4 is a schematic view of the mold and the medicament container during a sealing step of the blow-fill-seal process.

FIG. 4 is a schematic view of the mold 1 and the medicament container 2' during a sealing step of the blow-fill-seal process. The mandrel unit 4 is withdrawn and a movable head 1.5 of the mold 1 closes thus forming a seal distally from a neck 2.2' of the medicament container, e.g. by vacuum.

Figure 5:
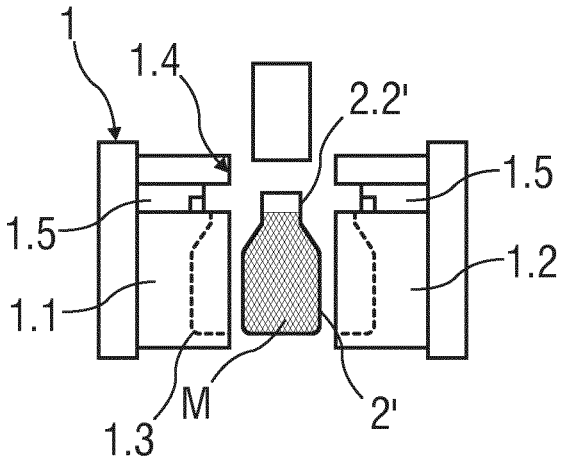
FIG. 5 is a schematic view of the mold and the medicament container during removal of the medicament container.

FIG. 5 is a schematic view of the mold 1 and the medicament container 2' during removal of the medicament container 2'. The mold 1 is opened, i.e. the halves 1.1, 1.2 are moved apart and the medicament container 2' is removed from the mold 1. The cycle of the blow-fill-seal process may then start anew with another extrusion step.

According to the disclosure, the mold 1 is dimensioned such that the neck 2.2' of the medicament container 2' is formed with an internal radius small enough to allow for a capillary effect within the neck 2.2' so that an air bubble remaining in the neck 2.2' after filling and sealing is fixed within the neck 2.2' by capillary forces. In an exemplary embodiment, the internal radius of the neck 2.2' is such that a capillary pressure of at least 100 mBar is generated.

This prevents the air bubble from moving through the medicament M when the medicament container 2' is moved, e.g. during shipping. Movement of the air bubble within the medicament M can otherwise subject the medicament M to shear forces which may cause degeneration of the medicament M. As the medicament M is filled into the medicament container 2' from bottom to top, the air bubble is already located at the top of the medicament container 2', e.g. within the neck 2.2' after the filling step. In the sealing step, the movable head 1.5 of the mold 1 is closed such that the neck 2.2' is cut through a section holding the air bubble, not the medicament M.

This avoids distortion of molecules of the medicament M and thus formation of metabolites of the molecules and decomposition of the medicament M.

In an exemplary embodiment, the internal radius of the neck 2.2' at most 1.4 mm. This allows for using filling tubes having 2.5 mm diameter.

In an exemplary embodiment, the neck 2.2' has a length of 7 mm to 30 mm.

The capillary effect of the neck 2.2' also depends from the type of medicament M used, in particular from its characteristics as a liquid.

Figure 6:
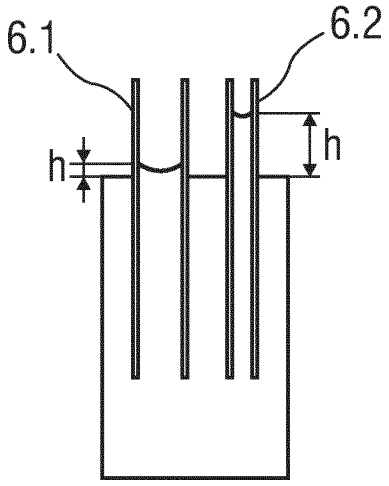
FIG. 6 is a schematic view of capillaries filled with liquids depending on capillary pressure.

FIG. 6 is a schematic view of capillaries 6.1, 6.2 filled with liquids, wherein a height of the liquid column depends on capillary pressure p(h). The neck 2.2' of the medicament container 2' may be arranged as such a capillary 6.1, 6.2.

The capillary pressure p(h) is given by the equation $p(h)=\zeta gh$, wherein $\zeta$ is the density of the liquid, e.g. the medicament M, g is the local acceleration due to gravity and wherein h is the height of the liquid column within the capillary 6.1, 6.2.

The height h of the liquid column is given by the equation $$h = \frac{2\sigma \cos\theta}{\rho g r},$$

wherein r is the radius of the capillary 6.1, 6.2, $\sigma$ is the liquid-air surface tension, $\theta$ is the contact angle, $\rho$ is the density of liquid.

In an exemplary embodiment, the liquid is water having a liquid-air surface tension $\sigma$ of 0.0728 $J/m^2$ at a temperature of 20° C., a density $\rho$ of 1000 $kg/m^3$ and a contact angle $\theta$ of 0.34906585 rad.

In the exemplary embodiment, the local acceleration g due to gravity is 9.81 $m/s^2$ and the radius r of the capillary 6.1, 6.2 is 1.2 mm. The resulting height h of the liquid column is thus 11.6 mm. The resulting capillary pressure p(h) is thus 114 hPa or 114 mbar.

In an exemplary embodiment, a product of the height h of the liquid column and the radius r of the capillary 6.1, 6.2 should be lower than 0.0002.

Figure 7:
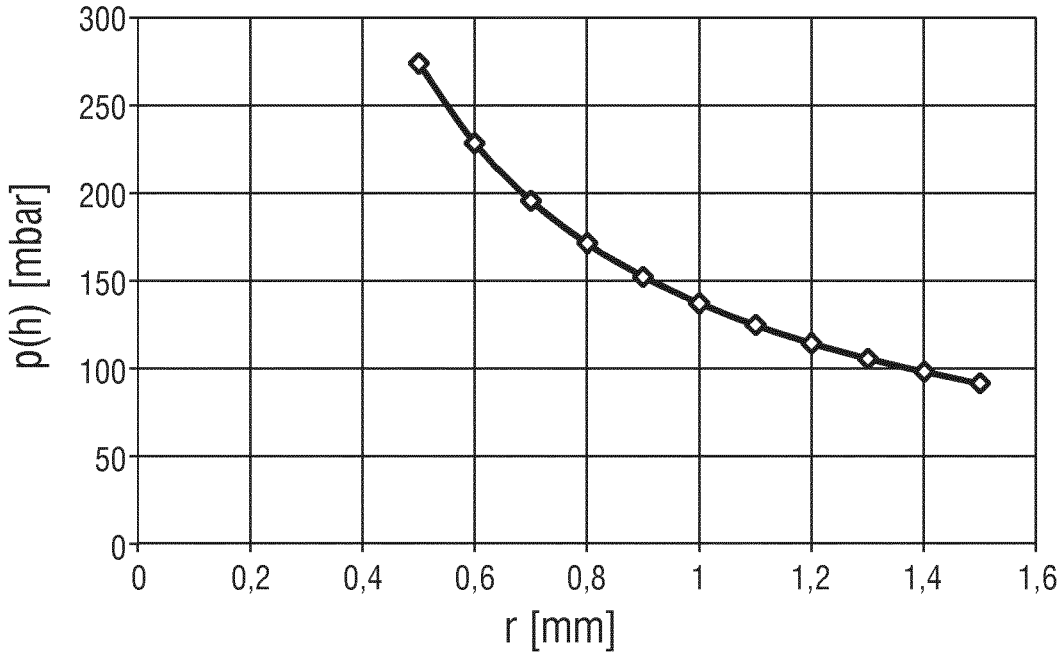
FIG. 7 is a diagram showing capillary pressure as a function of a radius of a capillary.

FIG. 7 is a diagram showing the capillary pressure p(h) as a function of the radius r of the capillary 6.1, 6.2.

The terms "drug" or "medicament" are used herein to describe one or more pharmaceutically active compounds. As described below, a drug or medicament can include at least one small or large molecule, or combinations thereof, in various types of formulations, for the treatment of one or more diseases. Exemplary pharmaceutically active compounds may include small molecules; polypeptides, peptides and proteins (e.g., hormones, growth factors, antibodies, antibody fragments, and enzymes); carbohydrates and polysaccharides; and nucleic acids, double or single stranded DNA (including naked and cDNA), RNA, antisense nucleic acids such as antisense DNA and RNA, small interfering RNA (siRNA), ribozymes, genes, and oligonucleotides. Nucleic acids may be incorporated into molecular delivery systems such as vectors, plasmids, or liposomes. Mixtures of one or more of these drugs are also contemplated.

The term "drug delivery device" shall encompass any type of device or system configured to dispense a drug into a human or animal body. Without limitation, a drug delivery device may be an injection device (e.g., syringe, pen injector, auto injector, large-volume device, pump, perfusion system, or other device configured for intraocular, subcutaneous, intramuscular, or intravascular delivery), skin patch (e.g., osmotic, chemical, micro-needle), inhaler (e.g., nasal or pulmonary), implantable (e.g., coated stent, capsule), or feeding systems for the gastro-intestinal tract. The presently described drugs may be particularly useful with injection devices that include a needle, e.g., a small gauge needle.

The drug or medicament may be contained in a primary package or "drug container" adapted for use with a drug delivery device. The drug container may be, e.g., a cartridge, syringe, reservoir, or other vessel configured to provide a suitable chamber for storage (e.g., short- or long-term storage) of one or more pharmaceutically active compounds. For example, in some instances, the chamber may be designed to store a drug for at least one day (e.g., 1 to at least 30 days). In some instances, the chamber may be designed to store a drug for about 1 month to about 2 years. Storage may occur at room temperature (e.g., about 20° C.), or refrigerated temperatures (e.g., from about −4° C. to about 4° C.). In some instances, the drug container may be or may include a dual-chamber cartridge configured to store two or more components of a drug formulation (e.g., a drug and a diluent, or two different types of drugs) separately, one in each chamber. In such instances, the two chambers of the dual-chamber cartridge may be configured to allow mixing between the two or more components of the drug or medicament prior to and/or during dispensing into the human or animal body. For example, the two chambers may be configured such that they are in fluid communication with each other (e.g., by way of a conduit between the two chambers) and allow mixing of the two components when desired by a user prior to dispensing. Alternatively or in addition, the two chambers may be configured to allow mixing as the components are being dispensed into the human or animal body.

The drug delivery devices and drugs described herein can be used for the treatment and/or prophylaxis of many different types of disorders. Exemplary disorders include, e.g., diabetes mellitus or complications associated with diabetes mellitus such as diabetic retinopathy, thromboembolism disorders such as deep vein or pulmonary thromboembolism. Further exemplary disorders are acute coronary syndrome (ACS), angina, myocardial infarction, cancer, macular degeneration, inflammation, hay fever, atherosclerosis and/or rheumatoid arthritis.

Exemplary drugs for the treatment and/or prophylaxis of diabetes mellitus or complications associated with diabetes mellitus include an insulin, e.g., human insulin, or a human insulin analogue or derivative, a glucagon-like peptide (GLP-1), GLP-1 analogues or GLP-1 receptor agonists, or an analogue or derivative thereof, a dipeptidyl peptidase-4 (DPP4) inhibitor, or a pharmaceutically acceptable salt or solvate thereof, or any mixture thereof. As used herein, the term "derivative" refers to any substance which is sufficiently structurally similar to the original substance so as to have substantially similar functionality or activity (e.g., therapeutic effectiveness).

Exemplary insulin analogues are Gly(A21), Arg(B31), Arg(B32) human insulin (insulin glargine); Lys(B3), Glu (B29) human insulin; Lys(B28), Pro(B29) human insulin; Asp(B28) human insulin; human insulin, wherein proline in position B28 is replaced by Asp, Lys, Leu, Val or Ala and wherein in position B29 Lys may be replaced by Pro; Ala(B26) human insulin; Des(B28-B30) human insulin; Des(B27) human insulin and Des(B30) human insulin.

Exemplary insulin derivatives are, for example, B29-N-myristoyl-des(B30) human insulin; B29-N-palmitoyl-des (B30) human insulin; B29-N-myristoyl human insulin; B29-N-palmitoyl human insulin; B28-N-myristoyl LysB28ProB29 human insulin; B28-N-palmitoyl-LysB28ProB29 human insulin; B30-N-myristoyl-ThrB29LysB30 human insulin; B30-N-palmitoyl-ThrB29LysB30 human insulin; B29-N—(N-palmitoyl-gamma-glutamyl)-des(B30) human insulin; B29-N—(N-lithocholyl-gamma-glutamyl)-des(B30) human insulin; B29-N-(ω-carboxyheptadecanoyl)-des(B30) human insulin and B29-N-(ω-carboxyheptadecanoyl) human insulin. Exemplary GLP-1, GLP-1 analogues and GLP-1 receptor agonists are, for example: Lixisenatide/AVE0010/ZP10/Lyxumia, Exenatide/Exendin-4/Byetta/Bydureon/ITCA 650/AC-2993 (a 39 amino acid peptide which is produced by the salivary glands of the Gila monster), Liraglutide/Victoza, Semaglutide, Taspoglutide, Syncria/Albiglutide, Dulaglutide, rExendin-4, CJC-1134-PC, PB-1023, TTP-054, Langlenatide/HM-11260C, CM-3, GLP-1 Eligen, ORMD-0901, NN-9924, NN-9926, NN-9927, Nodexen, Viador-GLP-1, CVX-096, ZYOG-1, ZYD-1, GSK-2374697, DA-3091, MAR-701, MAR709, ZP-2929, ZP-3022, TT-401, BHM-034. MOD-6030, CAM-2036, DA-15864, ARI-2651, ARI-2255, Exenatide-XTEN and Glucagon-Xten.

An exemplary oligonucleotide is, for example: mipomersen/Kynamro, a cholesterol-reducing antisense therapeutic for the treatment of familial hypercholesterolemia.

Exemplary DPP4 inhibitors are Vildagliptin, Sitagliptin, Denagliptin, Saxagliptin, Berberine.

Exemplary hormones include hypophysis hormones or hypothalamus hormones or regulatory active peptides and their antagonists, such as Gonadotropine (Follitropin, Lutropin, Choriongonadotropin, Menotropin), Somatropine (Somatropin), Desmopressin, Terlipressin, Gonadorelin, Triptorelin, Leuprorelin, Buserelin, Nafarelin, and Goserelin.

Exemplary polysaccharides include a glucosaminoglycane, a hyaluronic acid, a heparin, a low molecular weight heparin or an ultra-low molecular weight heparin or a derivative thereof, or a sulphated polysaccharide, e.g. a poly-sulphated form of the above-mentioned polysaccharides, and/or a pharmaceutically acceptable salt thereof. An example of a pharmaceutically acceptable salt of a poly-sulphated low molecular weight heparin is enoxaparin sodium. An example of a hyaluronic acid derivative is Hylan G-F 20/Synvisc, a sodium hyaluronate.

The term "antibody", as used herein, refers to an immunoglobulin molecule or an antigen-binding portion thereof. Examples of antigen-binding portions of immunoglobulin molecules include F(ab) and $F(ab')_2$ fragments, which retain the ability to bind antigen. The antibody can be polyclonal, monoclonal, recombinant, chimeric, de-immunized or humanized, fully human, non-human, (e.g., murine), or single chain antibody. In some embodiments, the antibody has effector function and can fix complement. In some embodiments, the antibody has reduced or no ability to bind an Fc receptor. For example, the antibody can be an isotype or subtype, an antibody fragment or mutant, which does not support binding to an Fc receptor, e.g., it has a mutagenized or deleted Fc receptor binding region.

The terms "fragment" or "antibody fragment" refer to a polypeptide derived from an antibody polypeptide molecule (e.g., an antibody heavy and/or light chain polypeptide) that does not comprise a full-length antibody polypeptide, but that still comprises at least a portion of a full-length antibody polypeptide that is capable of binding to an antigen. Antibody fragments can comprise a cleaved portion of a full length antibody polypeptide, although the term is not limited to such cleaved fragments. Antibody fragments that are useful in the present disclosure include, for example, Fab fragments, F(ab')2 fragments, scFv (single-chain Fv) fragments, linear antibodies, monospecific or multispecific antibody fragments such as bispecific, trispecific, and multispecific antibodies (e.g., diabodies, triabodies, tetrabodies), minibodies, chelating recombinant antibodies, tribodies or bibodies, intrabodies, nanobodies, small modular immunopharmaceuticals (SMIP), binding-domain immunoglobulin fusion proteins, camelized antibodies, and VHH containing antibodies. Additional examples of antigen-binding antibody fragments are known in the art.

The terms "Complementarity-determining region" or "CDR" refer to short polypeptide sequences within the variable region of both heavy and light chain polypeptides that are primarily responsible for mediating specific antigen recognition. The term "framework region" refers to amino acid sequences within the variable region of both heavy and light chain polypeptides that are not CDR sequences, and are primarily responsible for maintaining correct positioning of the CDR sequences to permit antigen binding. Although the framework regions themselves typically do not directly participate in antigen binding, as is known in the art, certain residues within the framework regions of certain antibodies can directly participate in antigen binding or can affect the ability of one or more amino acids in CDRs to interact with antigen.

Exemplary antibodies are anti PCSK-9 mAb (e.g., Alirocumab), anti IL-6 mAb (e.g., Sarilumab), and anti IL-4 mAb (e.g., Dupilumab).

The compounds described herein may be used in pharmaceutical formulations comprising (a) the compound(s) or pharmaceutically acceptable salts thereof, and (b) a pharmaceutically acceptable carrier. The compounds may also be used in pharmaceutical formulations that include one or more other active pharmaceutical ingredients or in pharmaceutical formulations in which the present compound or a pharmaceutically acceptable salt thereof is the only active ingredient. Accordingly, the pharmaceutical formulations of the present disclosure encompass any formulation made by admixing a compound described herein and a pharmaceutically acceptable carrier.

Pharmaceutically acceptable salts of any drug described herein are also contemplated for use in drug delivery devices. Pharmaceutically acceptable salts are for example acid addition salts and basic salts. Acid addition salts are e.g. HCl or HBr salts. Basic salts are e.g. salts having a cation selected from an alkali or alkaline earth metal, e.g. Na+, or K+, or Ca2+, or an ammonium ion N+(R1)(R2)(R3)(R4), wherein R1 to R4 independently of each other mean: hydrogen, an optionally substituted C1-C6-alkyl group, an optionally substituted C2-C6-alkenyl group, an optionally substituted C6-C10-aryl group, or an optionally substituted C6-C10-heteroaryl group. Further examples of pharmaceutically acceptable salts are known to those of skill in the arts.

Pharmaceutically acceptable solvates are for example hydrates or alkanolates such as methanolates or ethanolates.

Those of skill in the art will understand that modifications (additions and/or removals) of various components of the substances, formulations, apparatuses, methods, systems and embodiments described herein may be made without departing from the full scope and spirit of the present disclosure, which encompass such modifications and any and all equivalents thereof.

The invention claimed is:

1. A method for producing, filling and sealing a medicament container, the method comprising:

inflating a parison within a mold to form the medicament container;

filling a medicament into the medicament container; and sealing a distal end of a neck of the medicament container, wherein the mold is dimensioned such that the neck of the medicament container is formed with an internal radius small enough to allow for a capillary effect of the medicament so that an air bubble remaining in the neck after filling and sealing the medicament container is fixed within the neck by capillary forces.

2. The method according to claim 1, wherein the mold is dimensioned such that the neck is formed with an internal radius small enough to allow for a capillary effect of the medicament with a capillary pressure of at least 100 mBar.

3. The method according to claim 1, wherein the mold is dimensioned such that the neck is formed with an internal radius of at most 1.4 mm.

4. The method according to claim 1, wherein the mold is dimensioned such that the neck is formed with a length of 7 mm to 30 mm.

5. A method for producing, filling and sealing a medicament container, the method comprising:

inflating a parison within a mold to form the medicament container;

filling a medicament into the medicament container; and sealing a distal end of a neck of the medicament container, wherein the mold is dimensioned such that the neck of the medicament container is formed with an internal radius small enough to allow for a capillary effect of the medicament so that an air bubble remaining in the neck after filling and sealing the medicament container is fixed within the neck by capillary forces, and wherein during sealing, the neck is cut through a section holding the air bubble.

6. The method according to claim 5, wherein the mold is dimensioned such that the neck is formed with an internal radius small enough to allow for a capillary effect of the medicament with a capillary pressure of at least 100 mBar.

7. The method according to claim 5, wherein the mold is dimensioned such that the neck is formed with an internal radius of at most 1.4 mm.

8. The method according to claim 5, wherein the mold is dimensioned such that the neck is formed with a length of 7 mm to 30 mm.

* * * * *